US005707408A

United States Patent [19]

Kudo

[11] Patent Number: 5,707,408

[45] Date of Patent: Jan. 13, 1998

[54] METHOD AND APPARATUS FOR PRODUCTION OF FUEL GAS

[75] Inventor: Hideoki Kudo, Shizuoka, Japan

[73] Assignee: Yugen Kaisha Libo, Tokyo, Japan

[21] Appl. No.: 532,578

[22] PCT Filed: Apr. 22, 1994

[86] PCT No.: PCT/JP94/00663

§ 371 Date: Oct. 20, 1995

§ 102(e) Date: Oct. 20, 1995

[87] PCT Pub. No.: WO94/24232

PCT Pub. Date: Oct. 27, 1994

[30] Foreign Application Priority Data

Apr. 22, 1993 [JP] Japan ..... 5-118973
Oct. 13, 1993 [JP] Japan ..... 5-280134

[51] Int. Cl.[6] ..... C10J 1/20

[52] U.S. Cl. ..... 48/117; 48/79; 48/144; 48/199 R; 48/199 FM; 48/219

[58] Field of Search ..... 48/79, 117, 144, 48/199 R, 199 FM, 219

[56] References Cited

U.S. PATENT DOCUMENTS

| | | | |
|---|---|---|---|
| 3,257,180 | 6/1966 | King | 48/144 |
| 3,920,416 | 11/1975 | Houseman | 48/117 |
| 3,982,910 | 9/1976 | Houseman et al. | 48/117 |

FOREIGN PATENT DOCUMENTS

| | | |
|---|---|---|
| 0 002 936A3 | 7/1979 | European Pat. Off. . |
| 423094 | 10/1924 | Germany . |
| 53-102905 | 9/1978 | Japan . |
| 54-132603 | 10/1979 | Japan . |
| 56-11992 | 2/1981 | Japan . |
| 58-176939 | 11/1983 | Japan . |
| 63-12116 | 3/1988 | Japan . |
| 2-42048 | 3/1990 | Japan . |

*Primary Examiner*—Timothy McMahon
*Attorney, Agent, or Firm*—Nikaido Marmelstein Murray & Oram, LLP

[57] ABSTRACT

Production of fuel gas which generates little nitrogen oxides on combustion, has a prolonged combustion period for unit volume, and presents a high combustion temperature.

Alcohol or other liquid fuel is burnt in a fuel layer 20 in a combustion chamber 18 to generate a primary fuel gas, which is mixed in a gas pipe 14 with pressurized air ejected by an air nozzle 16, where spiral flow of air is formed around the ejected air. The ratio of the cross section of the primary fuel gas flow to that of air ejected from the air nozzle 16 is first decreased and then increased, so that vortices are formed in the area where the cross section changes to react the primary fuel gas with air and decompose hydrocarbons in the primary fuel gas into carbon and hydrogen with high reactivity, thus producing a fuel gas capable of high temperature combustion with low amount of nitrogen oxides generated.

28 Claims, 9 Drawing Sheets

METHOD AND APPARATUS FOR PRODUCTION OF FUEL GAS

FIELD OF THE INVENTION

The present invention relates to a method and apparatus for production of fuel gas for such devices as internal and external combustion engines, boilers, stoves, and fuel cells.

PRIOR ART

Conventional fuels for devices listed above have included fossile fuels such as petroleum and coal, alcohol, natural gas, or gases obtained from fossile fuels. These substances need steady high temperatures for efficient combustion. However, a disadvantage of high-temperature combustion is formation of nitrogen oxides (NOx).

In automobile engines, for example, without a denitrifying device have therefore to use a lower combustion temperature, which imposes a limit to the thermal efficiency (or, fuel consumption) of the engines. In addition, emission of NOx cannot be sufficiently controlled even with low combustion temperatures.

Another disadvantage is that the fuels listed above, except alcohol, are nonrenewable, and therefore lead possibly to depletion of the resources or damages on environment in mining.

Alcohol is renewable by a cycle: plants (biomasses) $\rightarrow$alcohol$\rightarrow CO_2+H_2O \rightarrow$plants. It is also free from the problem of uneven distribution of resources. However, the volume of alcohol needed to obtain a given amount of energy is three times as much as that of gasoline, which results in problems such as high costs for transportation and storage, large volumes of fuel tanks for automotive application, low power per vehicle weight, and difficult cold start.

SUMMARY OF THE INVENTION

In view of the problems described above, the present invention provides a method and an apparatus for production of fuel gas, from sources such as alcohol, petroleum or natural gas, which can be burnt at high temperatures with very low amount of nitrogen oxides formed, and has a calorific value higher than three times what is expected from conventional fuels, thus enabling the renewable alcohol to be employed as an automotive fuel.

The invention is based on discovery of a reaction in which a primary fuel gas, obtained by heating or combustion of a fuel, is mixed with air in spiral and/or vortex flow to decompose hydrocarbons in the primary fuel gas into carbon and hydrogen. The reaction produces carbon and hydrogen with increased reactivity which facilitates combustion at high temperatures. Combustion of carbon and hydrogen forms lower amounts of nitrogen oxides.

The invention achieves its purpose by a method of fuel gas production characterized by mixing a primary fuel gas, obtained by heating a fuel up to a temperature equal to or higher than the boiling point but lower than the flash point, with air in a single channel, both in the same flowing direction, forming at least one of spiral flow and vortex flow, to obtain a secondary fuel gas. Mixing of the primary fuel gas with air as flows in the same direction in a single channel decomposes hydrocarbons in the primary fuel gas into carbon and hydrogen with enhanced reactivity, thus forming a secondary fuel gas containing the easily burning hydrogen and carbon.

According to the invention, one of said primary fuel gas and air is injected into said channel at a position at or around the center of its cross section, while the other is flowing down the same channel. The simple injection of the one into the other results in a mixed flow which promotes the reaction.

According to the invention, the ratio of the cross section of the flow of said primary fuel gas to that of air is initially decreased, and again increased downstream. Said primary fuel gas is mixed with pressurized air at a point upstream to the point where the diameter of the channel is increased. Here the ratio of the cross section of the primary fuel gas to that of air flow is decreased, and again increased at the point where the inner diameter of the gas pipe is increased. At this point vortices are formed along the boundary to promote the reaction continuously and efficiently.

According to the invention, one of said primary fuel gas and air flows in a cross section smaller than that of said channel along the center line of said channel, while the other party flows spirally around said center line. This arrangement forms a strong spiral flow to promote the reaction.

According to the invention, said primary fuel gas contains the combustion gas formed by combustion of said fuel. The primary fuel gas at a temperature equal to or higher than the boiling point and lower than the flash point is obtained at low costs by simple combustion of said fuel. An optimum condition for the reaction is easily found due to the simplicity of the reaction process.

According to the invention, said primary fuel gas may contain the combustion gas formed by combustion of said fuel and unreacted gases, which help formation of highly active carbon and hydrogen atoms on reaction with air by mixing with the latter, in addition to generation of the primary fuel gas at low costs by simple combustion of said fuel.

According to the invention, said primary fuel gas may contain air, which prevents excessively high temperature of the primary fuel gas and thus protects the reaction vessel.

According to the invention, said fuel is at least one of liquid, gaseous and solid fuel, thus providing a wide range of selection of fuels.

According to the invention, said liquid fuel is at least one of alcohol or liquid hydrocarbon, which assures continuous combustion. Alcohol is renewable and can easily be obtained from plants.

According to the invention, said gaseous fuel is at least one of natural gas, carbon monoxide, hydrogen, methane, propane and butane, which facilitates control of the fuel gas generating process.

According to the invention, said solid fuel is at least one of coal, wax, charcoal, cellulose and coke, which enables application of the present invention even when liquid or gaseous fuel is unavailable.

The invention achieves its purpose by means of a gas production apparatus comprising a fuel gas source which supplies primary fuel gas obtained by heating fuel to a temperature equal to or higher than the boiling point and lower than flash point; a gas pipe which has a larger inner diameter at the tip than at the bottom and leads the primary fuel gas from said fuel gas source to a definite direction; and an air nozzle to eject pressurized air downstream into the said primary fuel gas, located on the center line of said gas pipe with the tip positioned between the point where the inner diameter of the pipe is increased and the bottom of the pipe. Said primary fuel gas is mixed with pressurized air at a point situated upstream to the point where the diameter of the channel is increased. Here the ratio of the cross section of the primary fuel gas to that of air flow is decreased, and again increased at the point where the inner diameter of the gas pipe is increased. This arrangement promotes the reaction continuously and efficiently.

According to the invention, said air nozzle located on the center line of the gas pipe is arranged so that its position along the center line is adjustable. By adjusting the position of the air nozzle the reaction generating the secondary fuel gas may be controlled.

The invention achieves its purpose by means of a gas production apparatus comprising a fuel gas source which supplies primary fuel gas obtained by heating fuel to a temperature equal to or higher than the boiling point and lower than flash point; a gas pipe which leads the primary fuel gas from said fuel gas source to a definite direction; an air nozzle to eject pressurized air downstream into the said primary fuel gas, located in said gas pipe with the tip thereof; and a means to form a mixed flow comprising at least one of spiral flow and vortex flow that mixes said primary fuel gas with air from the air nozzle in said gas pipe. This arrangement promotes the reaction of the primary fuel gas with air by ejecting pressurized air into the primary fuel gas to form a mixed spiral and/or vortex flow in which the two components are mixed, thus providing efficiently at a high temperature a secondary fuel gas that burns efficiently at a high temperature with little nitrogen oxides formed.

According to the invention, said means to form a mixed flow includes an inner surface of said gas pipe, closely downstream to the tip of said air nozzle, which limits to a specific value the expansion outwardly in the radial direction of pressurized air flow coming out of said air nozzle. This surface reflects the pressurized air flow from said air nozzle impinging on it, forming vortices that promotes the mixing of air with the primary fuel gas to render the reaction more efficient.

According to the invention, said means to form a mixed flow may includes at least one air inlet hole pierced through the wall of said gas pipe at a position close to the tip of said air nozzle. External air introduced into the pipe through said hole(s) generates vortices in the gas pipe at the position around the hole(s), again promoting the reaction of air with the primary fuel gas.

According to the invention, said means to form a mixed flow may includes a portion of said gas pipe closely downstream to the tip of the air nozzle at which the inner diameter is increased. When the pressurized air from the air nozzle passes through the portion of said gas pipe closely downstream to the tip of the air nozzle at which the inner diameter is increased, vortices are formed at this stepped portion, which promotes the reaction of air with the primary fuel gas.

According to the invention, said means to form a mixed flow may comprise fins to form a spiral flow placed around the tip of said air nozzle and arranged in the same oblique angle against the gas flow, so that said primary fuel gas form a spiral flow around the pressurized air from said air nozzle, promoting the reaction of the primary fuel gas with air.

According to the invention, said means to form a mixed flow may comprise a gas nozzle which is connected to said fuel gas source, located close to the tip of said air nozzle in a direction oblique to the center line of said air nozzle to form mixed flow, and ejects the primary fuel gas, producing easily spiral flow that promotes the reaction of the two components.

According to the invention, said air nozzle may consists of two or more small nozzles with different lengths arranged around the center line of said gas pipe, serving also as a means to form mixed flow, through which air is ejected to form a strong mixed flow that promotes the reaction.

According to the invention, said small nozzles may be located spirally along a virtual conical surface around the center line of said gas pipe, placed with its apex directed downstream but not protruding from the end of the pipe. This arrangement assures easy formation of mixed flow by ejecting pressurized air.

According to the invention, a virtual spiral formed by the tip of said small nozzles is right-handed when viewed downstream, which arrangement has experimentally proved to be more effective in enhancement of the reaction.

According to the invention, said means to form mixed flow may comprise a means, made of a heat-resistant material, to modify the cross section of the channel which consists of a surface inclined to the center line of said air nozzle and at least one orifice formed through the surface, and is located in said gas pipe between the end of said gas pipe and the tip of said air nozzle. The inclined surface and the orifice therein modifies the ratio of the cross section of air flow from the air nozzle and that of primary fuel gas flow around it when the two components pass through the orifice, thus promoting formation of vortices.

According to the invention, said means to modify the cross section of the channel may consist of a plate through which a number of orifices are formed. This can be realized using punched metal, for example, and is capable of forming many vortices with a simple structure.

According to the invention, said means to modify the cross section of the channel may be constructed by forming metal mesh in a conical spiral. This arrangement allows a simple realization of the means to modify the cross section, through which the primary fuel gas and air pass to form many vortices. A layered construction of the mesh leads to a more vigorous reaction.

According to the invention, said air nozzle located on the center line of the gas pipe is arranged so that its position along the center line is adjustable. By adjusting the position of the air nozzle the reaction generating the secondary fuel gas may easily be controlled.

According to the invention, said means to form mixed flow may consist of a first reaction cylinder made of a heat-resistant material with a number of through holes formed as a hollow cone with the base directed downstream in said gas pipe, and a second reaction coil formed by winding spirally a plate of a heat-resistant material with a number of through holes with one of the ends connected to the base of said first reaction cylinder, said air nozzle being connected to the apex of said first reaction cylinder to eject pressurized air into the latter. This arrangement allows formation of vortices in several steps when the primary fuel gas and pressurized air from the air nozzle pass through the spiral second reaction coil, thus promoting the reaction further.

According to the invention, said means to form mixed flow may consist of a reaction cylinder made of a heat-resistant material with a number of through holes formed by spirally winding a sheet of the material as a hollow truncated cone with the larger base directed downstream, said air nozzle being connected to the center of the smaller base of said reaction cylinder to eject pressurized air into the latter. This arrangement comprising of a reaction cylinder formed spirally as a truncated cone inclined to the air and primary fuel gas flow allows formation of vortices that mix the primary fuel gas with air in several steps.

According to the invention, said fuel gas source consists of a combustion chamber, in which the fuel is burnt, provided with an air inlet and a combustion air outlet, the latter being connected with the bottom end of said gas pipe. This arrangement allows formation of the primary fuel gas by simply burning the fuel in the combustion chamber, thus presenting a device with simple structure, which can be easily controlled, at a low cost.

According to the invention, said combustion chamber may be a cylinder with an air inlet at the one end and a combustion gas outlet on the other end, the fuel being formed into a layer covering at least a part of the inner surface of said cylinder, resulting in efficient generation of a large amount of the primary fuel gas.

According to the invention, the fuel layer in said combustion chamber may be formed using a porous material impregnated with a liquid fuel, which assures stable combustion of the liquid fuel.

According to the invention, said fuel gas source may comprise a vessel to contain the fuel and a means to heat the fuel. This arrangement allows formation of the primary fuel gas simply by heating the fuel in the vessel, thus eliminating the combustion device for the primary fuel.

DESCRIPTION OF THE PREFERRED EMBODIMENTS

Figure 1:
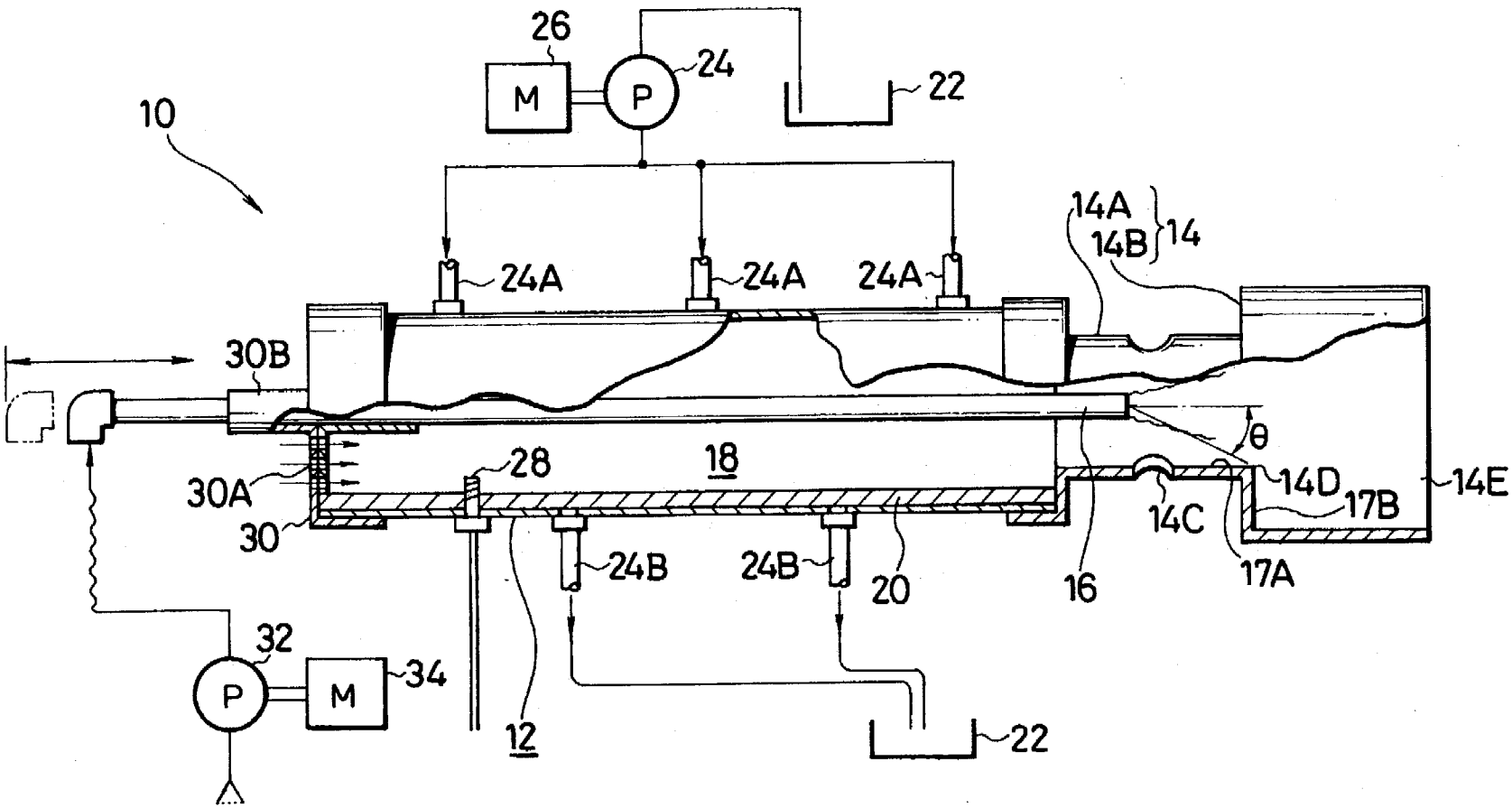
FIG. 1 is a sectional view of an embodiment of the apparatus for production of fuel gas according to the invention including block diagrams for some components.

Embodiments of the invention are described below referring to the drawings.

FIG. 1 shows a fuel gas generating unit 10 associated with a first embodiment of the invention, comprising of a fuel gas source 12 which generates the primary fuel gas by burning a liquid fuel such as alcohol; a gas pipe 14 which directs the primary fuel gas generated by the fuel gas source 12 to a definite direction (from left to right in the figure); an air nozzle 16 with the tip in the gas pipe 14 which ejects pressurized air in the same direction as that of the primary fuel gas; and a means to form mixed flow 17 which mixes the primary fuel gas with air from the air nozzle 16 in spiral and/or vortex flow in the gas pipe 14.

Said fuel gas source 12 has a combustion chamber 18 made of cylindrical shaped metallic material. The inner surface of the combustion chamber 18 is provided with a fuel layer 20, consisting of a metal with continuous pores, for example, to which liquid fuel is circulated and supplied from a fuel tank 22 by a pump 24. FIG. 1 shows in addition a motor 26 to drive the pump 24, and an ignition plug 28 which ignites fuel at the surface of the fuel layer 20.

In the figure, the right end of said combustion chamber 18 is open and is connected to said gas pipe 14, while the left end has a cover 30 with air inlet holes 30A.

Said gas pipe 14 comprises a portion of a smaller diameter 14A connected to said combustion chamber 18 and a portion of a larger diameter 14B connected to the right end of the portion 14A in the figure. Several air inlet holes 14C are pierced peripherally through said portion 14A at an appropriate distance.

The inner surface 17A of said portion 14A, the step 17B between the portions 14A and 14B, and the air inlet holes 14C constitute a means to form mixed flow 17.

Said air nozzle 16 runs through the center of said cover 30 of said combustion chamber 18, and the tip is located in the portion of a smaller diameter 14A close to said air inlet holes 14C on the center line of said gas pipe 14.

Said air nozzle 16 is formed by a metallic pipe and held by a pipe guide 30B formed on the cover 30 so that the nozzle can be shifted in the axial direction. In FIG. 1, numeral 32 denotes a pump to supply pressurized air to the air nozzle 16, 34 denotes a motor to drive the pump 32, 24A denotes a fuel nozzle to supply fuel to the combustion chamber 18, and 24B denotes a fuel purge nozzle to purge excess fuel not reacted in the fuel layer 20.

The angle θ formed by a straight line from the tip of the air nozzle 16 to the corner 14D forming transition from the portion 14A to 14B and the center line of said air nozzle 16 is preferably 30–65 degrees.

The action of the first embodiment shown in FIG. 1 is described below.

A liquid fuel, for example alcohol, is supplied to the fuel layer 20 in the combustion chamber 18 by the pump 24, and ignited by the ignition plug 28 at the surface of the fuel layer 20, where it burns mildly oozing out of the layer 20.

Figure 2:
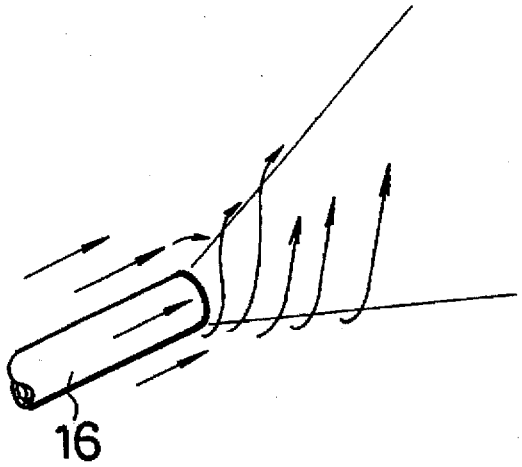
FIG. 2 is a perspective view showing generation of spiral flow by compressed air flow.

In the meantime, pressurized air is supplied to the air nozzle 16 by the pump 32 and ejected into the portion 14A in the gas pipe 14. Air flow thus produced causes the combustion gas and unburnt gas, and air in the combustion chamber 18 flow into the gas pipe 14. Air sustaining the combustion of the fuel in the chamber 18 flows into the chamber 18 through the air inlet holes 30A in the cover 30. A part of said combustion gas, unburnt gas and air forms spiral flow around the strong air flow from the air nozzle 16 and eventually mixed with the latter (see FIG. 2).

Figure 3:
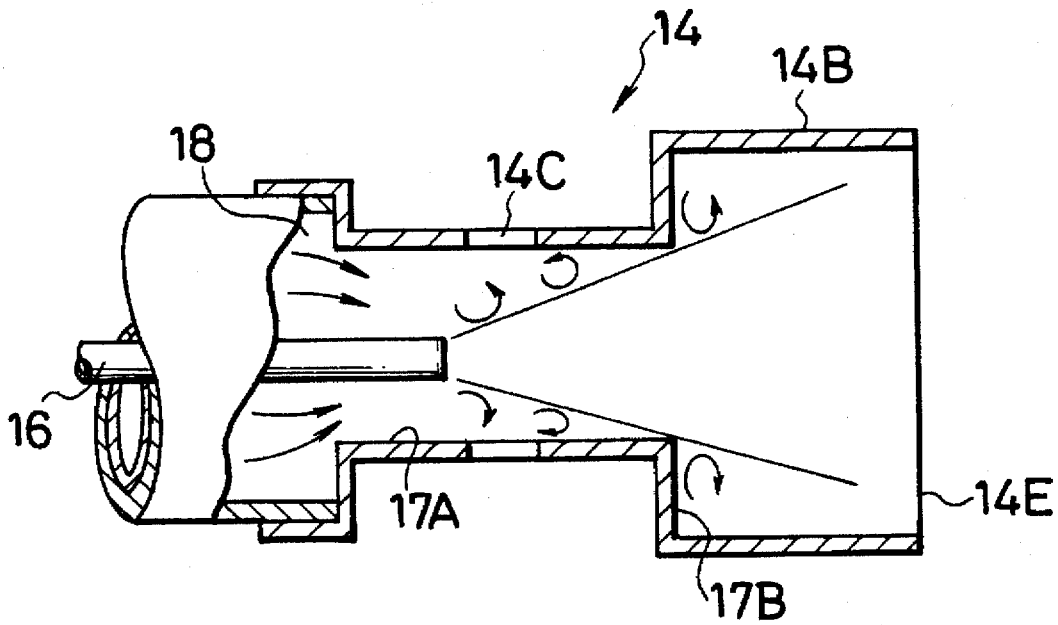
FIG. 3 is a sectional view of formation of vortices by compressed air flow.

At the position of the tip of the air nozzle, the cross section of the pressurized air increases when it is ejected from the air nozzle 16 into the gas pipe 14 under the normal pressure, but the increase is limited by the inner surface 17A of the portion of a smaller diameter 14A of the gas pipe, and, as a result, vortices are generated as shown in FIG. 3 along the boundary with the combustion gas from the chamber 18 (primary fuel gas), whose cross section relatively diminishes in the same portion, and mixes the two streams vigorously to promote the reaction.

Air intake through the air inlet holes 14C in the portion 14A near the tip of the air nozzle 16 also produces vortices along the boundary with the primary fuel gas.

The total cross section of the flow of the primary fuel gas and pressurized air from the air nozzle 16 increases considerably when the flow reaches the portion of a greater diameter 14B of the gas pipe 14, whereupon the boundary between the primary fuel gas and air passes through the corner 14D. Vortices are generated near the step 17B, which promotes the reaction of the primary fuel gas with air, thus providing a secondary fuel gas at the outlet 14E of the gas pipe 14.

The reaction can be controlled by adjusting the amount of fuel supplied to the fuel layer 20, air flow to be ejected from the air nozzle 16, and the position of the tip of the air nozzle 16.

Experiments performed by the inventor have shown that combustion of a secondary fuel gas obtained from alcohol (methyl alcohol, ethyl alcohol or a mixture thereof) endured three times longer than that of simple combustion, with a maximum combustion temperature of 1,600° C. (as compared with 800° C. obtained in normal combustion). The longer duration of combustion and higher combustion temperature result from an excited state of carbon and hydrogen atoms, obtained by decomposition of the primary fuel gas in reaction with air, which burn at a high rate and high temperature.

Measurements have shown that the exhaust gas after combustion of the secondary fuel gas contained very small amount of nitrogen oxides (NOx), since the nitrogen content of the fuel gas was very low in comparison with the combustible components.

Figure 4:
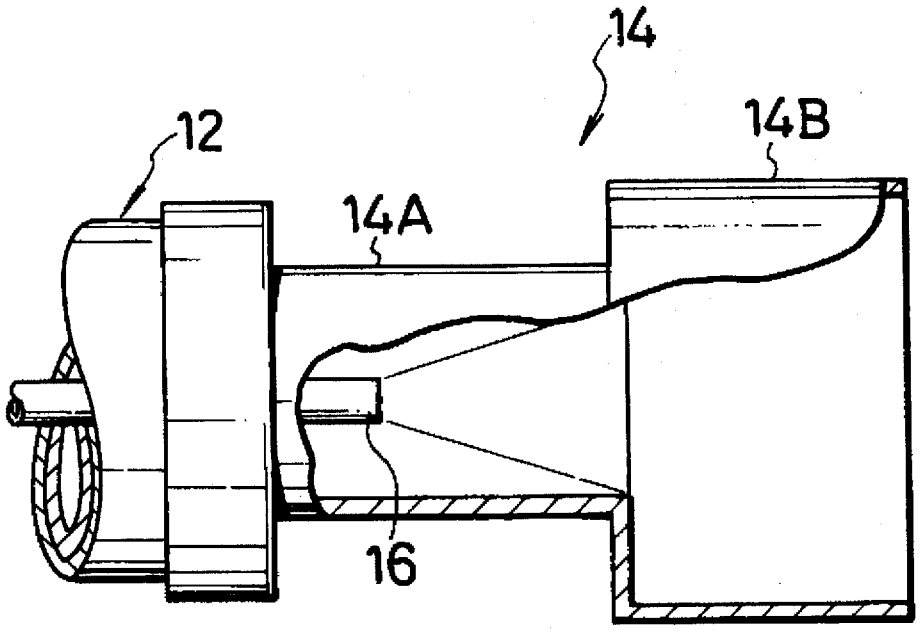
FIG. 4 is a sectional view of an essential part of a second embodiment of the apparatus for production of fuel gas.

The air inlet holes 14C in the portion of a smaller diameter 14A of the gas pipe 14 in said first embodiment shown in FIG. 1 do not limit the scope of the invention, and can be eliminated as in a second embodiment of the invention shown in FIG. 4 as far as the reaction proceeds satisfactorily with pressurized air from the air nozzle 16.

Figure 5:
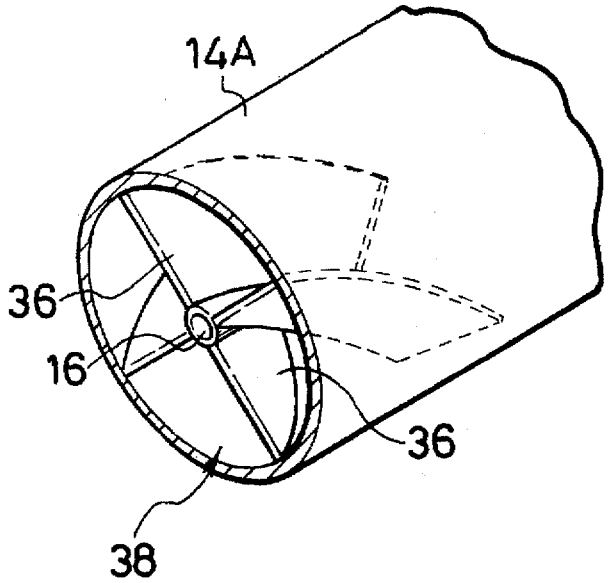
FIG. 5 is a sectional view of an essential part of a third embodiment.

A third embodiment of the invention shown in FIG. 5 is described below.

In the third embodiment, fins 36 to form a spiral flow, arranged in the same oblique angle against the gas flow, are placed around the air nozzle 16 at a position upstream to the tip in the gas pipe 14 connected to the combustion chamber 18 as in the first embodiment. The fins 36, the air inlet holes 14C, the inner surface 17A and the step 17B constitutes a means to form mixed flow 38.

In this particular embodiment, the fins 36 are directed to form a right-handed screw in order to produce a right-handed spiral flow of the primary fuel gas around the air nozzle 16.

Therefore, the primary fuel gas leaving the combustion chamber 18 and to be involved in the pressurized air flow from the air nozzle 16 is forcibly turned into right-handed spiral flow by the fins 36.

This arrangement provides vigorous mixing of air ejected from the air nozzle 16 with the primary fuel gas in a strong spiral flow, thus promoting the reaction.

In addition to the spiral flow formed by the fins 36, the boundary areas of air flow from the air intake holes 14C and from the air nozzle 16, and at the step 17B, as in the first embodiment, contribute to formation of vortices which promote reaction of the primary fuel gas with air.

Figure 6:
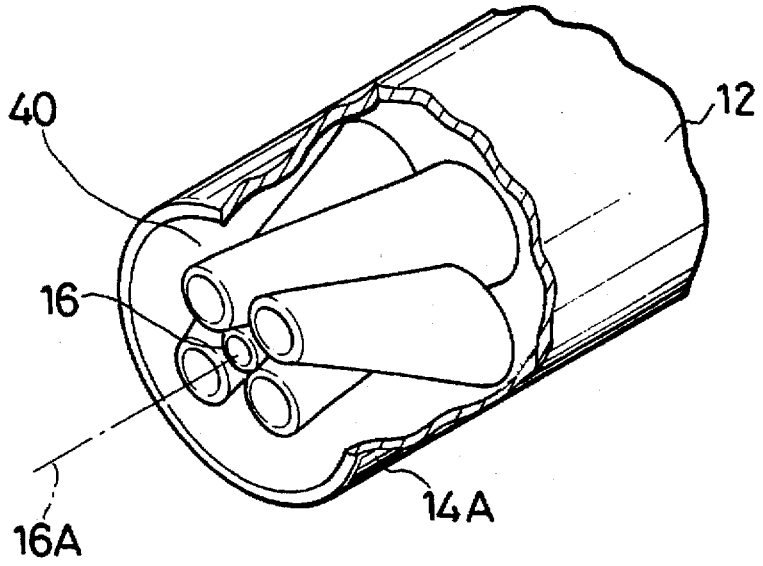
FIG. 6 is a sectional view of an essential part of a fourth embodiment.

A fourth embodiment of the invention shown in FIG. 6 is described below.

In this fourth embodiment, gas nozzles 40 are provided at the connecting part of said combustion chamber 18 and said gas pipe 14, in such an arrangement that the nozzles eject the primary fuel gas in right-handed spiral flow around the center line 16A of the air nozzle 16.

In this fourth embodiment, the primary fuel gas from the combustion chamber 18 is forcibly turned into right-handed spiral flow, as in the third embodiment, by the obliquely arranged gas nozzles 40, thus mixing the primary fuel gas with air effectively and vigorously and promoting the reaction.

Figure 7:
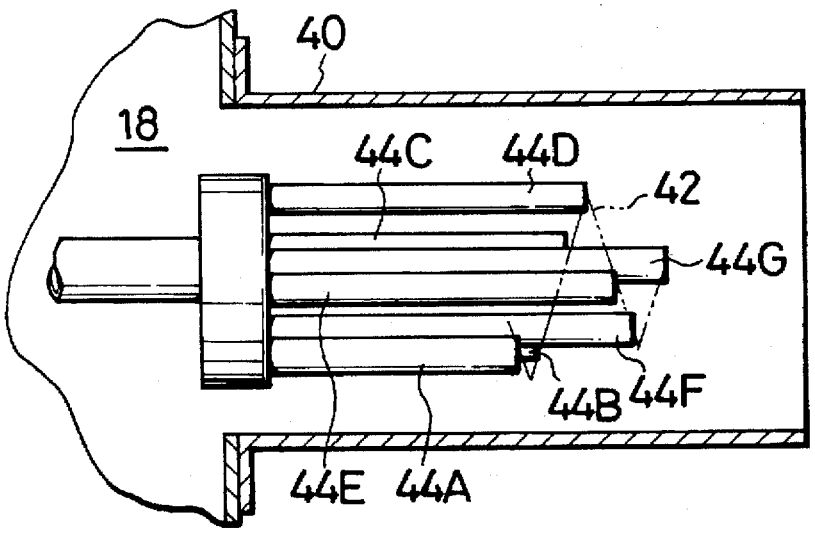
FIG. 7 is a sectional view of an essential part of a fifth embodiment.
Figure 8:
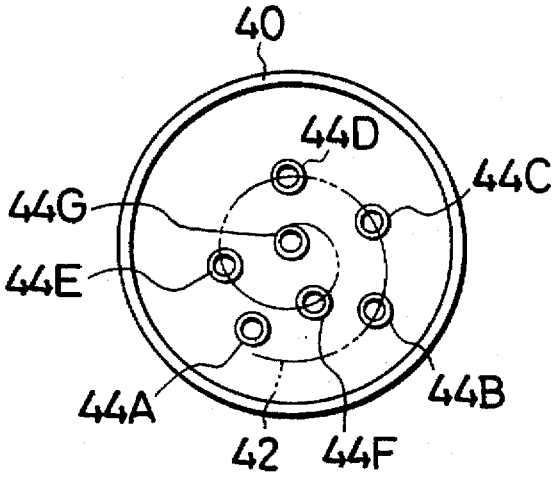
FIG. 8 is a frontal view of an essential part of the fifth embodiment.

A fifth embodiment of the invention shown in FIGS. 7 and 8 is described below.

In this fifth embodiment, seven air nozzles 44A–44G are located spirally along a virtual conical surface 42 placed with its apex directed downstream in the gas pipe 14 connected to a combustion chamber 18 similar to that in the first embodiment.

In this embodiment, pressurized air ejected from the nozzles 44A–44G forms spiral flow in the gas pipe 14, thus promoting reaction of the primary fuel gas with air.

Figure 9:
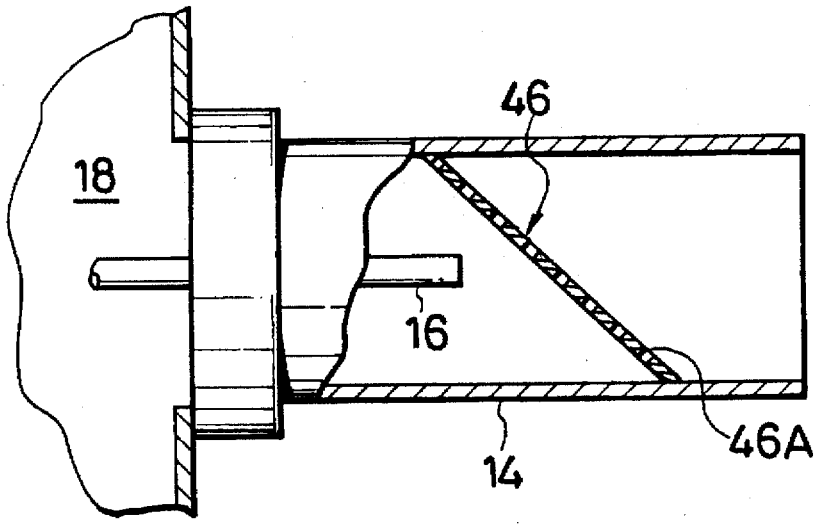
FIG. 9 is a frontal view of an essential part of a sixth example of the invention.

A sixth embodiment of the invention shown in FIG. 9 is described below.

In the sixth embodiment, a punched metal sheet 46 is provided in the gas pipe 14, connected to a combustion chamber 18 similar to that in the first embodiment, closely downstream to the tip of the air nozzle 16, in an arrangement oblique to the air flow.

In this embodiment, vortices are formed when the primary fuel gas from the combustion chamber 18 and pressurized air flow from the air nozzle 16 pass through a number of orifices 46A formed through the punched metal sheet 46 due to decrease and increase in relative cross sections of the flows, giving rise to the same reaction as in the first embodiment.

Figure 10:
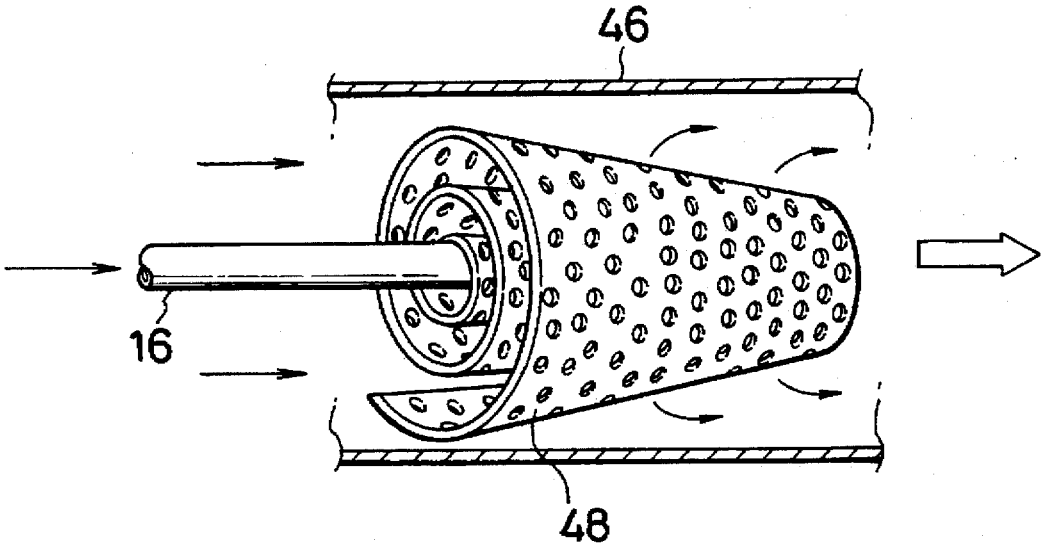
FIG. 10 is a perspective view of an essential part of a seventh embodiment.

A seventh embodiment of the invention shown in FIG. 10 is described below.

In this seventh embodiment, a means to modify the cross section of the channel 48 constructed by forming metal mesh in a conical spiral is provided in the gas pipe 14 connected to a combustion chamber 18 similar to that in the first embodiment.

In this seventh embodiment, a number of vortices are generated when the primary fuel gas and pressurized air from the air nozzle 16 pass through the spiral mesh due to changes in relative cross sections of the flows, thus promoting the reaction.

Figure 11:
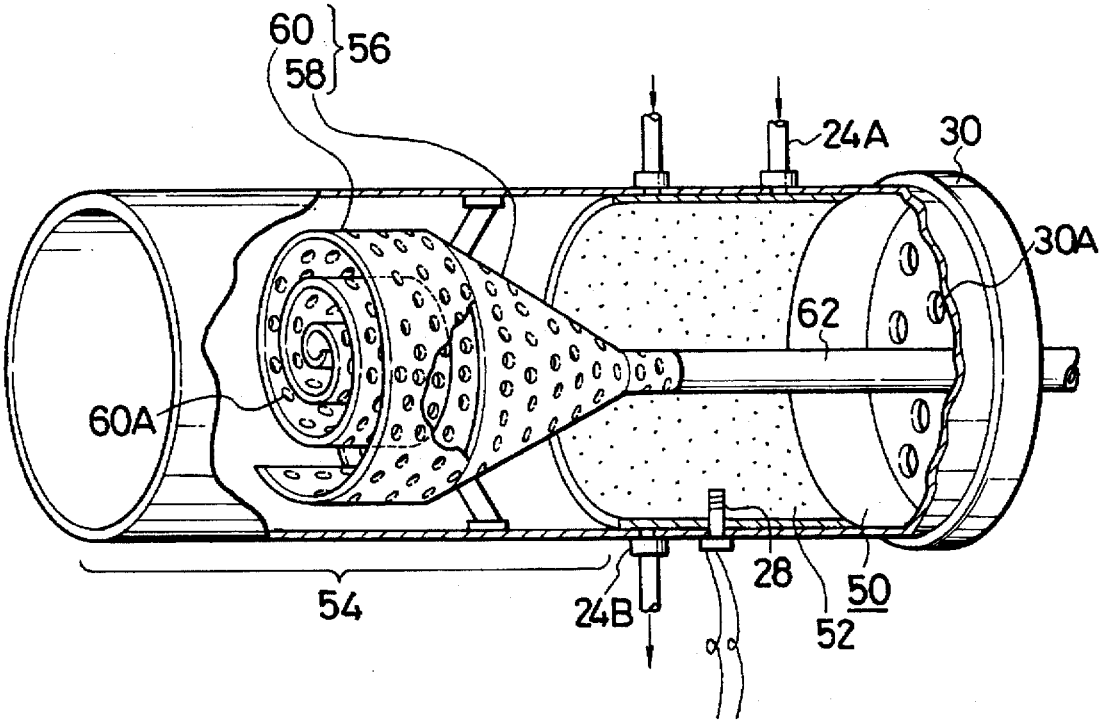
FIG. 11 is a partially sectioned perspective view of an eighth embodiment of the invention.

An eighth embodiment of the invention shown in FIG. 11 is described below.

In the eighth embodiment, a combustion chamber 50, similar to that in the first embodiment, is extended beyond the end of the fuel layer 52, thus constituting a gas pipe 54, in which a reaction cylinder portion 56 is provided as a principal element of a means to form mixed flow.

The reaction cylinder portion 56 consists of a first reaction cylinder made of a heat-resistant material, such as a metal or a ceramic, with a number of through holes 58A formed as a hollow cone with the base directed downstream, and a reaction coil 60 formed by winding spirally a plate of a heat-resistant material, as used in the first reaction cylinder 56, with a number of through holes 60A with one of the ends connected to the base of the first reaction cylinder 58.

The tapered apex of said reaction cylinder 58 is connected to an air nozzle 62 to eject pressurized air into the cylinder 58. The connecting part of the cylinder 58 has the same diameter as that of the air nozzle 62, and provided with through holes 60A in the wall.

In FIG. 11, numeral 64 denotes a stay to hold the reaction cylinder 56 in the combustion chamber 50, and other components are numbered by the same numerals of the same components in the first embodiment shown in FIG. 1 and description of the other components is omitted.

In this embodiment, vortices are generated when the primary fuel gas generated in the combustion chamber 50 enters the first reaction cylinder 58 through the holes 60A by the action of pressurized air ejected from the air nozzle 62 into the central region of the apex of the reaction cylinder 56 to give rise to reaction with the air. Additionally, a number of vortices are formed when the mixture moves from the central region of the reaction coil 60 outwardly passing through the holes 58A therein repeatedly, causing the reaction at a number of sites and thus producing a secondary fuel gas capable of sustaining high temperature combustion.

In this embodiment, the maximum combustion temperature of the gas formed is increased by increasing the number of turns of the reaction coil 60. The total calorific value is determined by the amount of fuel supplied to the fuel layer 52 and the amount of air supply from the air nozzle 62.

Figure 12:
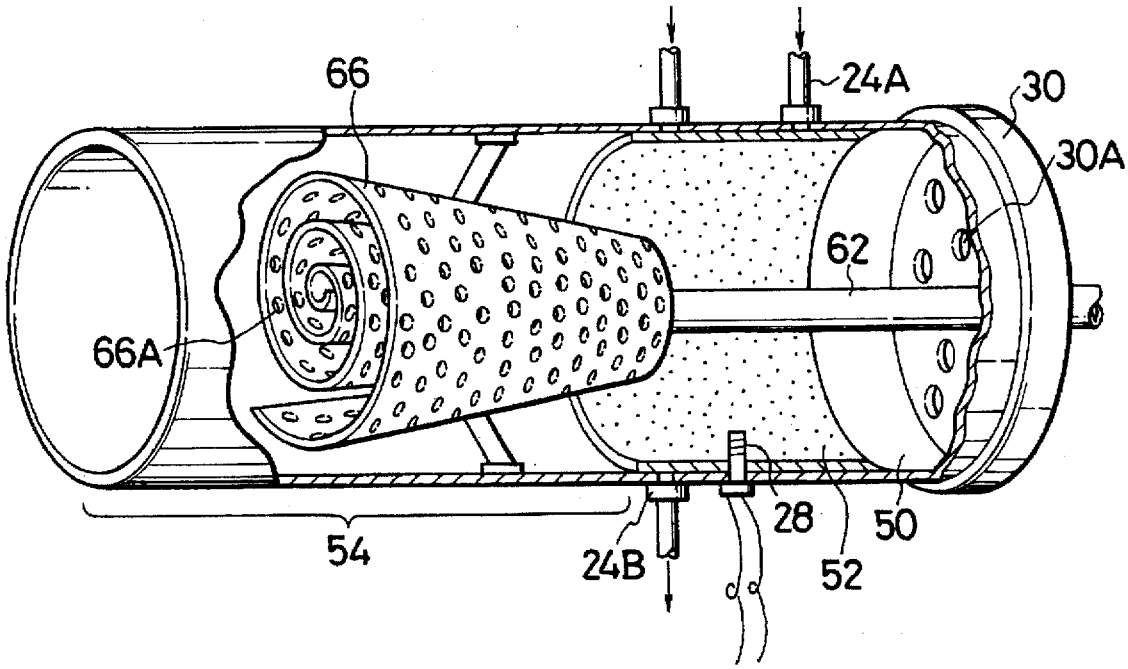
FIG. 12 is a perspective view of a ninth embodiment.

A ninth embodiment of the invention shown in FIG. 12 is described below.

In the ninth embodiment, a reaction cylinder 66 with a number of through holes 66A, formed by spirally winding a sheet of a heat-resistant material, such as a metal or a ceramic, as a hollow truncated cone with the larger base directed downstream, is provided instead of the reaction cylinder 58 in the eighth embodiment (FIG. 11), and the air nozzle 62 is connected to the center of the smaller end surface (base end side) of the reaction cylinder 66 to eject pressurized air into the latter.

In this embodiment, vortices are formed and reaction occurs when the primary fuel gas flows into the reaction cylinder 66, pressurized air ejected into the central region of the cylinder 66. The reaction of the primary fuel gas is further enhanced when the mixture passes through the each layer of the coil in the reaction cylinder 66, thus producing a secondary fuel gas capable of sustaining high temperature combustion. An advantage of this embodiment is that the reaction cylinder 66 can be fabricated simply by winding spirally a punched metal sheet to form a truncated cone.

In the embodiments described above, the primary fuel gas is obtained by burning a liquid fuel, such as alcohol, supplied to the fuel layer in the combustion chamber 50. This feature, however, does not limit the scope of the invention: any fuel gas obtained by heating a liquid, gaseous, or solid fuel or a mixture thereof to a temperature equal to or higher than the boiling point and lower than the flash point can be employed.

Figure 13:
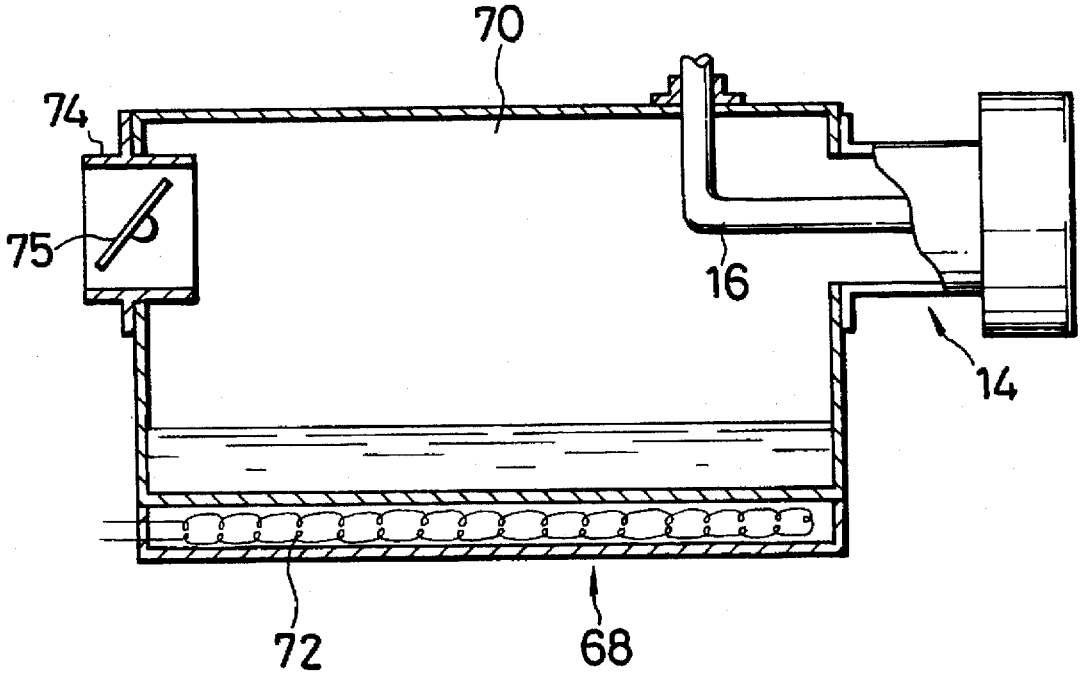
FIG. 13 is a sectional view of another embodiment of the fuel gas source to generate the primary fuel gas in the invention.

For example, as shown in FIG. 13, a primary fuel gas source 68 may consist of a fuel chamber 70 to contain a liquid, solid or gaseous fuel, and a heating means 72, such as an electric heating coil, to heat the fuel in the fuel chamber 70 to a temperature equal to or higher than the boiling point and lower than the flash point, the fuel gas generated by heating being sent to the gas pipe.

In the above, a throttle valve 75 provided at the air inlet 74 of the fuel chamber 70 can be used to adjust the air flow into the latter, thus controlling the gas generation.

In the embodiment described above, the fuel layer in the combustion chamber is made of foamed metal with continuous pores. This feature, however, does not limit the scope of the invention: any material with satisfactory heat resistance capable of impregnation of a liquid fuel may be employed, such as asbestos or metallic fibers.

In the embodiment described above, a liquid fuel such as alcohol is used. This feature, however, does not limit the scope of the invention: gaseous fuels such as city gas, natural gas, propane, methane, butane, carbon monoxide or hydrogen, may be used if the gas is heated in an appropriate location in the path.

In addition, a solid fuel such as coal, charcoal, cellulose, wax or coke may be used in the invention if a means of continuous generation of the primary fuel gas capable of supplying the fuel and discharging the combustion gas continuously. This means may be eliminated if only a short-period combustion is required.

CAPABILITY OF EXPLOITATION IN INDUSTRY

The fuel gas thus obtained can be supplied to an internal combustion engine with air and ignited to give a high efficiency in combustion. The fuel gas can equally be used with air in external combustion engines, boilers and stoves. The fuel gas as generated may be used in fuel cells, in which case the high temperature of the gas generated lead to a high efficiency in generating electricity.

I claim:

1. An apparatus for production of fuel gas, comprising:

a combustion chamber;

a fuel gas source which supplies primary fuel gas to said combustion chamber where said fuel gas is heated to a temperature equal to or higher than the boiling point and lower than the flash point;

a gas pipe having a first end and a second end, said first end communicating with said combustion chamber, said gas pipe defining a gas pipe axis extending from a cross-sectional center of said first end of said gas pipe to a cross-sectional center of said second end of said gas pipe, said gas pipe having at least one inlet hole through which an interior of said gas pipe communicates with an exterior of said gas pipe;

an outlet pipe, said outlet pipe communicating with said second end of said gas pipe, said outlet pipe having a cross-sectional area perpendicular to said gas pipe axis which is larger than the cross-sectional area of said gas pipe perpendicular to said gas pipe axis; and an air nozzle, said air nozzle having an entrance end and an exit end, said entrance end communicating with a source of air, said exit end of said air nozzle being positioned in said gas pipe, said air nozzle defining an air nozzle axis extending from a cross-sectional center of said entrance end of said air nozzle to a cross-sectional center of said exit end of said air nozzle, said air nozzle axis being substantially collinear with said gas pipe axis.

2. An apparatus for production of fuel gas according to claim 1, in which said air nozzle is arranged so that its position is adjustable along the gas pipe axis.

3. An apparatus for production of fuel gas according to claim 1, in which said at least one inlet hole is positioned close to said exit end of said air nozzle.

4. An apparatus for production of fuel gas according to claim 1, further comprising fins to form a spiral flow placed around the exit end of said air nozzle and arranged in the same oblique angle against the gas flow, so that said primary fuel gas forms a spiral flow around the pressurized air from said air nozzle.

5. An apparatus for production of fuel gas according to claim 1, further comprising a gas nozzle which is connected to said fuel gas source, located close to the exit end of said air nozzle in a direction oblique to said gas pipe axis and ejects the primary fuel gas.

6. An apparatus for production of fuel gas according to claim 1, further comprising two or more small nozzles with different lengths arranged around said gas pipe axis, serving also as a means to form mixed flow, through which air is ejected to form a mixed flow.

7. An apparatus for production of fuel gas according to claim 6, in which said small nozzles are arranged spirally along a virtual conical surface around said gas pipe axis placed with its apex directed downstream but not protruding from the end of the pipe.

8. An apparatus for production of fuel gas according to claim 7, in which a virtual spiral formed by the tip of said small nozzles is right-handed when viewed downstream.

9. An apparatus for production of fuel gas according to claim 1, further comprising a surface inclined to said gas pipe axis and at least one orifice formed through the surface, and is located in said gas pipe between said second end of said gas pipe and said exit end of said air nozzle.

10. An apparatus for production of fuel gas according to claim 9, in which said surface consists of a plate through which a number of orifices are formed.

11. An apparatus for production of fuel gas according to claim 9, in which said surface is constructed by forming metal mesh in a conical spiral.

12. An apparatus for production of fuel gas according to claim 1, in which said air nozzle is arranged so that its position is adjustable along said gas pipe axis.

13. An apparatus for production of fuel gas according to claim 1, further comprising a first reaction cylinder made of a heat-resistant material with a number of through holes formed as a hollow cone with the base directed downstream; and a second reaction coil formed by winding spirally a plate of a heat-resistant material with a number of through holes with one of the ends connected to the base of said first reaction cylinder, said air nozzle being connected to the apex of said first reaction cylinder to eject pressurized air into the latter.

14. An apparatus for production of fuel gas according to claim 1, further comprising a reaction cylinder made of a heat-resistant material with a number of through holes formed by spirally winding a sheet of the material as a hollow truncated cone with the larger base directed downstream, said air nozzle being connected to the center of the smaller base of said reaction cylinder to eject pressurized air into the latter.

15. An apparatus for production of fuel gas as recited in claim 1, said combustion chamber having a wall positioned between said entrance end of said air nozzle and said exit end of said air nozzle, said air inlet axis passing through a center of said wall, said wall having at least one opening formed therethrough such that an interior of said combustion chamber communicates with an exterior of said combustion chamber.

16. An apparatus for production of fuel gas according to any one of claims 1–4, in which said fuel gas source comprises a vessel to contain the fuel and a means to heat the fuel.

17. An apparatus for production of fuel gas according to any one of claims 1–14, in which said fuel gas source consists of a combustion chamber, in which the fuel is burnt, provided with an air inlet and a combustion air outlet, the latter being connected with said first end of said gas pipe.

18. An apparatus for production of fuel gas according to claim 17, in which said combustion chamber is a cylinder with said air inlet at one end and said combustion gas outlet on the other end, the fuel being formed into a layer covering at least a part of the inner surface of said cylinder.

19. An apparatus for production of fuel gas according to claim, 18, in which said fuel layer in said combustion chamber is formed using a porous material impregnated with a liquid fuel.

20. A method for production of fuel gas, comprising:

heating fuel to a temperature equal to or higher than the boiling point and lower than the flash point;

supplying said fuel to a first end of a gas pipe, said gas pipe also having a second end, said gas pipe defining a gas pipe axis extending from a cross-sectional center of said first end of said gas pipe to a cross-sectional center of said second end of said gas pipe, said second end of said gas pipe communicating with an outlet pipe, said outlet pipe having a cross-sectional area perpendicular to said gas pipe axis which is larger than the cross-sectional area of said gas pipe perpendicular to said gas pipe axis;

feeding air to an entrance end of an air nozzle, said air nozzle also having an exit end, said exit end of said air nozzle being positioned in said gas pipe, said air nozzle defining an air nozzle axis extending from a cross-sectional center of said entrance end of said air nozzle to a cross-sectional center of said exit end of said air nozzle, said air nozzle axis being substantially collinear with said gas pipe axis;

feeding air through at least one inlet hole formed in said gas pipe through which an interior of said gas pipe communicates with an exterior of said gas pipe; thereby mixing said fuel gas and air to form a secondary fuel gas.

21. A method for production of fuel gas according to claim 20, in which said primary fuel gas contains the combustion gas formed by combustion of said fuel.

22. A method for production of fuel gas according to claim 20, in which said primary fuel gas contains the combustion gas formed by combustion of said fuel and unreacted gases.

23. A method for production of fuel gas according to claim 20, in which said primary fuel gas contains air.

24. A method for production of fuel gas according to claim 20, in which said fuel is at least one of liquid, gaseous and solid fuel.

25. A method for production of fuel gas according to claim 24, in which said liquid fuel is at least one of alcohol and liquid hydrocarbon.

26. A method for production of fuel gas according to claim 24, in which said gaseous fuel is at least one of natural gas, carbon monoxide, hydrogen, methane, propane and butane.

27. A method for production of fuel gas according to claim 24, in which said solid fuel is at least one of coal, wax, charcoal, cellulose and coke.

28. A method for production of fuel gas as recited in claim 20, wherein said heating said fuel gas is conducted in a combustion chamber which communicates with said first end of said gas pipe, further comprising feeding air into said combustion chamber through at least one opening in a wall of said combustion chamber, said wall being positioned such that a center thereof is located on said gas pipe axis.

* * * * *